US007025571B2

(12) United States Patent
Jeun

(10) Patent No.: US 7,025,571 B2
(45) Date of Patent: Apr. 11, 2006

(54) APPARATUS AND METHOD FOR CONTROLLING A RECIPROCATING COMPRESSOR

(75) Inventor: Young-Hwan Jeun, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 137 days.

(21) Appl. No.: 10/362,102

(22) PCT Filed: Jun. 21, 2001

(86) PCT No.: PCT/KR01/01057

§ 371 (c)(1),
(2), (4) Date: Feb. 21, 2003

(87) PCT Pub. No.: WO03/001063

PCT Pub. Date: Jan. 3, 2003

(65) Prior Publication Data

US 2003/0180151 A1 Sep. 25, 2003

(51) Int. Cl.
*F04B 49/06* (2006.01)

(52) U.S. Cl. ..... 417/44.11; 417/44.1; 417/417; 318/138; 318/432; 318/433; 318/434; 318/254; 318/721

(58) Field of Classification Search ..... 417/44.1, 417/44.11, 417; 318/430, 431, 432, 433, 318/434, 138, 254, 439, 721, 135
See application file for complete search history.

(56) References Cited

U.S. PATENT DOCUMENTS 4,067,667 A * 1/1978 White ..... 417/418
4,417,190 A * 11/1983 Nola ..... 318/729
4,613,285 A * 9/1986 Sato et al. ..... 417/214
4,664,685 A * 5/1987 Young ..... 62/6
4,803,568 A * 2/1989 Miyake et al. ..... 360/73.03
5,342,176 A * 8/1994 Redlich ..... 417/212
5,495,161 A * 2/1996 Hunter ..... 318/807
5,510,689 A * 4/1996 Lipo et al. ..... 318/809
5,900,822 A * 5/1999 Sand et al. ..... 340/648
6,857,858 B1 * 2/2005 Jeun ..... 417/45

FOREIGN PATENT DOCUMENTS

JP 61034370 2/1986
JP 4272487 9/1992
JP 9112438 5/1997

* cited by examiner

*Primary Examiner*—Charles G. Freay
*Assistant Examiner*—Emmanuel Sayoc
(74) *Attorney, Agent, or Firm*—McKenna Long Aldridge LLP

(57) ABSTRACT

Disclosed is an apparatus and method for controlling a reciprocating compressor capable of inexpensively and exactly controlling a position of a piston in a cylinder, by which a top clearance is minimized according to the information of a phase difference between a square wave of a piston stroke and a square wave of a current supplied to the compressor. The apparatus comprises a driving section for driving the reciprocating compressor by varying an angle or ignition in response to a control signal; a current phase detecting section for outputting a square wave corresponding to the detected current supplied to the compressor; a stroke phase detecting section for outputting a square wave corresponding to a stroke of the compressor; and a control section for controlling the angle of ignition of the driving section according to the phase difference between the square wave produced from the current phase detecting section and the square wave produced from the stroke phase detecting section.

27 Claims, 9 Drawing Sheets

APPARATUS AND METHOD FOR CONTROLLING A RECIPROCATING COMPRESSOR

TECHNICAL FIELD

The present invention relates to a reciprocating compressor, and more particularly to an apparatus and method for controlling a reciprocating compressor by controlling an output voltage according to a phase difference between a piston stroke waveform and a current waveform of the reciprocating compressor.

BACKGROUND ART

Recently, a reciprocating compressor has been developed to compress a refrigerant gas in a refrigerator and so on.

U.S. Pat. No. 5,342,176 discloses a reciprocating compressor using a linear motion motor and a method for controlling a piston stroke of the reciprocating compressor.

FIG. 1 is a cross sectional view illustrating the construction of a reciprocating compressor disclosed in U.S. Pat. No. 5,342,176, and FIG. 2 is a block diagram illustrating a compressor controlling apparatus for controlling a piston stroke of the refrigerant shown in FIG. 1.

According to the conventional reciprocating compressor, as shown in FIG. 1, a piston 1 reciprocates in a cylinder 2 in response to forces on magnets 4 to which the piston is connected by a yoke 3. The forces on the magnets are caused by magnetic fields set up by current in a winding 5. Piston motion is transmitted by the yoke linking the piston 1 to a spring 6, which has a spring constant K. During downward piston motion, gas or vapor at suction pressure, which is the pressure in a surrounding space 9 and also in the lower part of a compressor interior space 10, is drawn into the cylinder through a check valve 7. During upward motion of the piston, gas or vapor is initially compressed until the pressure in the cylinder exceeds the discharge pressure, that is, the pressure in a discharge pipe 11, at which a point check valve 8 opens and gas or vapor is pushed into the discharge pipe by continuing upward motion of the piston.

A conventional apparatus for controlling the reciprocating compressor as described above will now be described.

The reciprocating compressor comprises, as shown in FIG. 2, a voltage detecting section 13, connected to input terminals of winding 5, for detecting the voltage applied to the winding as a function of time, a current detecting section 12, connected to the winding 5, for detecting the current through the winding as a function of time, a computing section 14 for calculating a velocity of the piston using the voltage and current values detected by the voltage and current detecting sections 13 and 12 and operating the piston stroke from the velocity of the piston, and a commending section 15 for comparing the stroke value operated at the computing section 14 and a predetermined voltage value, determining a target output voltage to compensate the difference between the stroke value and the predetermined voltage value, and commanding it to a driving section 16.

A conventional method for controlling the prior reciprocating compressor will now be described.

Predetermined end displacement values (top and bottom dead points) are inputted.

By supplying a power to the motor of the compressor at a certain value, the voltage and current supplied to the winding of the compressor are detected as a function of time, respectively.

A displacement value of the piston is measured using the detected voltage and current.

By comparing the measured displacement value with the predetermined displacement value, an error signal corresponding to the comparison is outputted.

The voltage to be supplied to the winding of the motor is varied in corresponding to the error signal to minimize the error signal.

The step for outputting the error signal will be described.

$$v=(1/\alpha)(V-L(dI/dt)-IR) \quad \text{[Equation 1]}$$

wherein, $\alpha$ is a transfer constant, V is the voltage applied to the winding, I is the current detected from the winding, R is a winding resistance, L is a winding inductance, and t is time.

The velocity v of the reciprocating piston is calculated as a function of time from the detected voltage and current in accordance with the equation 1. The computed velocity is integrated as a function of time to compute the alternating component of displacement of the piston as a function of time. The computed velocity is differenced as a function of time to compute the acceleration of the piston as a function of time.

The alternating component of displacement is detected when the computed velocity is zero. Simultaneously, during a suction phase (moving towards the bottom dead point), the alternating component of displacement, the acceleration and the current are detected. The displacement of the reciprocating piston is calculated at the end of its excursion in accordance with a following equation 2.

$$Xc=x_i-x_o+(\alpha a/K)I_o-(M/K)A_o \quad \text{[Equation 2]}$$

wherein, Xc is the end displacement, $x_i$ is the alternating displacement when the velocity is zero, $x_o$ is the simultaneously detected alternating displacement, $A_o$ is the simultaneously detected acceleration, Io is the simultaneously detected current, M is the mass of the reciprocating body, and K is the spring constant of the spring.

By comparing the command signal with the computed end displacement signal Xc, an error signal is generated.

The prior apparatus and method for controlling the reciprocating compressor using the above displacement-voltage feedback has following disadvantages.

Firstly, because the critical value of the dead point of the displacement of the piston has to be exactly calculated, the complicated calculation of the dead point of the displacement causes to an error. Specifically, it is necessary to carry out the complicated calculation such as equations 1 and 2, thereby producing an error of the calculation.

Secondly, since expensive apparatuses such as a computer are used to carry out the complicated calculation, the cost increases.

Finally, according to the U.S. patent, after the ideal dead point of the displacement to be controlled is predetermined, the voltage is controlled in such a way that it is approached to the predetermined displacement. If the compressor is continuously used, the compressor is controlled using the predetermined displacement, in spite of the variation of the ideal displacement due to the mechanical wear. Therefore, it is impossible to exactly control the compressor.

Japanese Patent Laid-Open Publication hei 9-112438 discloses an apparatus and method for controlling the reciprocating compressor, in which an operating frequency is adjusted according to a resonance frequency so that the efficiency thereof is not reduced regardless of that a resonance frequency may be changed by the change of a spring constant of gas due to the fluctuation of the load.

FIG. 3 is a block diagram of one conventional control apparatus for the reciprocating compressor disclosed in the Japanese Patent Laid-Open Publication hei 9-112438, and FIG. 4 is a block diagram of another conventional control apparatus for a reciprocating compressor disclosed in the Japanese Patent Laid-Open Publication hei 9-112438.

The conventional control apparatus for a reciprocating compressor shown in FIG. 3 comprises an alternating power supply section 21 for supplying a driving power to the compressor 27 and having a controllable frequency of the output voltage, a voltage detecting section 22 for detecting an output voltage outputted from the alternating power supply section 21 to the compressor 27, a current detecting section 23 for detecting a current flowing>from the alternating power supply section 21 to the compressor 27, a phase detecting section 24 for detecting a phase difference between the output voltage detected from the voltage detecting section 22 and the current detected from the current detecting section 23, and a control section 25 for compensating a frequency of the output voltage of the alternating power supply section 21 corresponding to the phase difference detected from the phase detecting section 24 and coinciding the frequency with a resonance frequency of a piston of the compressor.

The conventional control method of the reciprocating compressor will now be described.

If the driving power is supplied to the reciprocating compressor 27 from the alternating power supply section 21, the reciprocating compressor 27 is driven. At that time, the voltage detecting section 22 and the current detecting section 23 detect the current and voltage applied to the compressor, respectively.

The phase detecting section 24 calculates a timing based on a waveform phase of the detected voltage value V and current value I, and calculates the phase difference Dp of the current I to the voltage V based on the calculated results.

The control section 25 calculates a frequency compensating amount ΔF corresponding to the phase difference Dp, and outputs a frequency control signal to the alternating power supply section 21 corresponding to a frequency control amount Ff (Ff=Ff+ΔF).

Even if the resonance frequency Fc of the piston is fluctuated due to the fluctuation of the load, the frequency F of the output voltage V of the alternating power supply section is controlled to be coincided to the resonance frequency Fc.

In addition, the control apparatus for a reciprocating compressor shown in FIG. 4 comprises an alternating power supply section 21 for supplying a driving power to the compressor 27 and having a controllable frequency of the output voltage, a voltage detecting section 22 for detecting an output voltage outputted from the alternating power supply section 21 to the compressor 27, a current detecting section 23 for detecting a current flowing from the alternating power supply section 21 to the compressor 27, a velocity detecting section 26 for detecting a piston velocity of the compressor 27 according to the detected results of the voltage detecting section 22 and the current detecting section 23, and a frequency control section 28 for detecting a phase difference between the current detected from the current detecting section 23 and the velocity detected from the velocity detecting section 26 to compensate the frequency of the output voltage of the alternating power supply section 21 corresponding to the detected phase difference, and coinciding the frequency with a resonance frequency of a piston of the compressor. The alternating power supply section 21 includes a DC power supply section 21*a* for supplying a DC power, and an inverter 21*b* for adjusting the frequency of the voltage outputted from the DC power supply section 21 a according to the control signal of the frequency control section 28.

The conventional control method of the reciprocating compressor will now be described.

The phase difference Dpie of the current I flowing from the alternating power supply section 21 to the compressor and the phase difference Dpve of the velocity of the piston to the voltage V are to be coincided with the resonance frequency Fc, thereby becoming zero degree. Also, if the driving frequency F is higher than the resonance frequency Fc, the phase of the current I goes ahead of that of the velocity v. If the driving frequency F is lower than the resonance frequency Fc, the phase of the current I is behind that of the velocity v. Accordingly, the compressor is controlled using the resonance frequency Fc variable depending upon the load, so that if the phase of the current I goes ahead of that of the velocity v, the driving frequency F is lowered, while if the phase of the current I goes ahead of that of the velocity v, the driving frequency F is raised.

However, the prior apparatus and method for controlling the reciprocating compressor disclosed in the Japanese Patent Laid-Open Publication has following disadvantage.

In order to control the frequency of the power supplied to the compressor, an expensive apparatus (inverter) has to be provided. Accordingly, since the cost of components is increased, it is impossible to provide an inexpensive control apparatus.

DISCLOSURE OF THE INVENTION

Therefore, an object of the present invention is to solve the problems involved in the prior art and to provide an apparatus and method for controlling a reciprocating compressor capable of inexpensively and exactly controlling a piston stroke of a compressor.

In order to accomplish the above object, the present invention is characterized by controlling an output voltage to be applied to the compressor according to a phase difference between a piston stroke waveform and a current waveform supplied to the compressor.

With the present invention, a top clearance of the piston stroke of the reciprocating compressor is determined depending upon the phase difference between the stroke and the current. It was found by a research in that the top clearance becomes zero when the phase difference is minimied.

In addition, the phase difference between the stroke and the current can be exactly detected by only a pattern of the stroke variation and a pattern of the current variation. The need of detecting the stroke variation only is unnecessary to an exact device.

The research can provide an apparatus for controlling the reciprocating compressor capable of inexpensively and exactly controlling the piston stroke. Specifically, the phase difference between a phase of the current supplied to a motor of the compressor and a phase of the stroke is set to a fluctuation point, and an input voltage when having the set phase difference is determined as a target output voltage.

In one aspect of the present invention, there is provided an apparatus for controlling a reciprocating compressor comprising: a driving section for driving the reciprocating compressor by varying an angle of ignition in response to a control signal; a current phase detecting section for outputting a square wave corresponding to the detected current supplied to the compressor; a stroke phase detecting section for outputting a square wave corresponding to a stroke of the compressor; and a control section for controlling the angle of ignition of the driving section according to the phase difference between the square wave produced from the current phase detecting section and the square wave produced from the stroke phase detecting section.

The current phase detecting section includes a current detecting section for detecting the current supplied to the compressor to output a detected current value, and a first square wave generating section for outputting a first square wave corresponding to the current detected from the current detecting section.

The current phase detecting section further includes an integrating section for integrating the current detected from the current detecting section to output the integrated current to the first square wave generating section.

The stroke phase detecting section includes a voltage detecting section for detecting a voltage supplied to the compressor, a stroke computing section for computing the stroke based on the voltage detected from the voltage detecting section and the current detected from the current detecting section, and a second square wave generating section for generating a second square wave corresponding to the stroke computed from the stroke computing section to output the second square wave to the control section.

The control section includes a phase difference measuring section for measuring a phase difference between a current waveform outputted from the current phase detecting section and a stroke waveform outputted from the stroke phase detecting section, and an output voltage commanding section for determining a target output voltage according to a size of the phase difference measured from the phase difference measuring section.

The output voltage commanding section includes a phase difference storing section for storing the phase difference detected from the phase difference measuring section, a phase difference comparing section for comparing the phase difference stored in the phase difference storing section with the phase difference measured from the phase difference measuring section, and a determining section for determining the voltage to be supplied to the compressor according to the compared result from the phase difference comparing section and outputting a write enable signal of the phase difference storing section.

The determining section determines whether a top of clearance is zero when the phase difference is minimized.

The determining section outputs a write enable signal so that when the phase difference detected from the phase difference measuring section is lower than that stored in the phase difference storing section, the phase difference storing section stores the phase difference detected from the phase difference measuring section.

The driving section includes a TRIAC for supplying the power to the compressor in response to a control signal, and a phase control section for controlling an angle of ignition for controlling the stroke of the compressor according to a control signal outputted from the control section and outputting the signal to the TRIAC.

The TRIAC switches the power according to the angle of ignition outputted from the phase control section.

The apparatus further comprises a zero crossing detecting section for detecting a zero crossing of a voltage of the power supplied from the driving section.

In another aspect of the present invention, there is provided a method for controlling a reciprocating compressor, the method comprising the steps of: a) driving the compressor by varying an angle of ignition, and measuring a phase difference between a current phase supplied to the compressor and a stroke phase of the compressor when the angle of ignition is varied; and b) comparing the measured phase differences, and driving the compressor at the angle of ignition corresponding to an inflection point of the phase difference.

The phase difference is minimized at the inflection point.

The current phase is generated by detecting the current supplied to the compressor and integrating the detected current.

The stroke phase is outputted as a pulse corresponding to an estimated value after detecting the voltage and the current supplied to the compressor and estimating the stroke using the detected voltage and current.

The step a comprises the steps of storing the detected phase difference when driving the compressor at an initial angle of ignition; measuring the phase difference by varying the angle of ignition in a desired direction, comparing the measured phase difference with a previously stored phase difference; substituting the measured phase difference for the stored phase difference if the measured phase difference is smaller than the stored phase difference; and repeating the measuring, comparing and substituting steps by varying the angle of ignition in same direction.

The method further comprises the step of varying the angle of ignition in a direction opposed to the previously varied direction, if the measured phase difference is larger than the initially stored phase difference.

The compressor is controlled by recognizing the angle of ignition as an inflection point of a previous step, if the measured phase difference is larger than the previously stored phase difference.

At the step a, the phase difference is measured by setting the angle of ignition to supply the current of sufficiently small value to the compressor at early stage and by varying the angle of ignition to supply the current of gradually increasing value to the compressor, and at the step b, the compressor is controlled by recognizing the angle of ignition as the inflection point of a previous step, when the measured phase difference is larger than the previously stored phase difference.

In still another aspect of the present invention, there is provided a method for controlling a reciprocating compressor, the method comprising the steps of: a) measuring and storing a phase difference between a first square wave corresponding to a current supplied to the compressor and a second square wave corresponding to an estimated stroke of the compressor, by driving the compressor at a desired angle of ignition; b) measuring a phase difference between a first square wave corresponding to the current supplied to the compressor and a second square wave corresponding to an estimated stroke of the compressor, by driving the compressor at varied angle of ignition in a desired direction; c) comparing the measured phase difference with a stored phase difference, to vary the angle of ignition in an opposed direction, if the measured phase difference is larger than the stored phase difference, and to substitute the measured phase difference for the stored phase difference and vary the angle of ignition in same direction, if the measured phase difference is smaller than the stored phase difference; and d) repeating the steps b and c to drive the compressor at a point in which the phase difference is deflected.

In still another aspect of the present invention there is provided a method for controlling a reciprocating compressor, the method comprising the steps of: a) measuring and storing a phase difference between a first square wave corresponding to a current supplied to the compressor and a second square wave corresponding to a stroke of the compressor by driving the compressor at an initial angle of ignition; b) measuring a phase difference between the first square wave and the second square wave by driving the compressor at varied angle of ignition; and c) comparing the measured phase difference with a stored phase difference, to vary the angle of ignition so that the measured phase difference is smaller than the stored phase difference and to control the compressor at the angle of ignition at which the phase difference is minimzed.

In still another aspect of the present invention, there is provided a method for controlling a position of a piston of a reciprocating compressor, the method comprising the steps of: a) generating a first square wave corresponding to a current supplied to the compressor by the compressor at a certain angle of ignition; b) generating a second square wave corresponding to a stroke of the compressor; and c) adjusting the angle of ignition according to a phase difference between the first and second square waves to control operation of the compressor.

At the step c, a control signal for controlling the piston is outputted so that a top clearance is minimized according to the phase difference between the first and second square waves.

In still anther aspect of the present invention, there is provided a method for controlling a reciprocating compressor, the method comprising the steps of: a) tabling and storing a phase difference between a current corresponding to a load and a stroke; b) measuring a present load, and reading the phase difference corresponding to the measured load from the table; c) measuring a phase difference between a current supplied to the compressor and a stroke of the compressor by driving the compressor at an initial angle of ignition; and d) comparing the measured phase difference with the read phase difference to vary the angle of ignition so that the measured phase difference is close to the read phase difference.

The step c comprises the steps of detecting the current supplied to the compressor and generating a first square wave corresponding to the current, detecting a voltage supplied to the compressor, calculating the stroke of the compressor using the detected voltage and current, generating a second square wave corresponding to the calculated stroke, and measuring a phase difference between the first and second square waves.

The first square wave is generated by integrating the detected current.

At the step c, the initial angle of ignition is set so that the phase difference between the current supplied to the compressor and the stroke of the compressor is sufficiently larger than the read phase difference, and at the step d, by controlling the angle of ignition to cause the phase difference between the current supplied to the compressor and the stroke of the compressor to be gradually decreased, and by comparing the measured phase difference with the read phase difference, the compressor is controlled at a previous angle of ignition at a moment that the measured phase difference is smaller than the read phase difference.

BRIEF DESCRIPTION OF THE DRAWINGS

The above objects, other features and advantages of the present invention will become more apparent by describing the preferred embodiment thereof with reference to the accompanying drawings, in which.

BEST MODE FOR CARRYING OUT THE INVENTION

Now, preferred embodiments of the present invention will be described in detail with reference to the annexed drawings.

Figure 1:
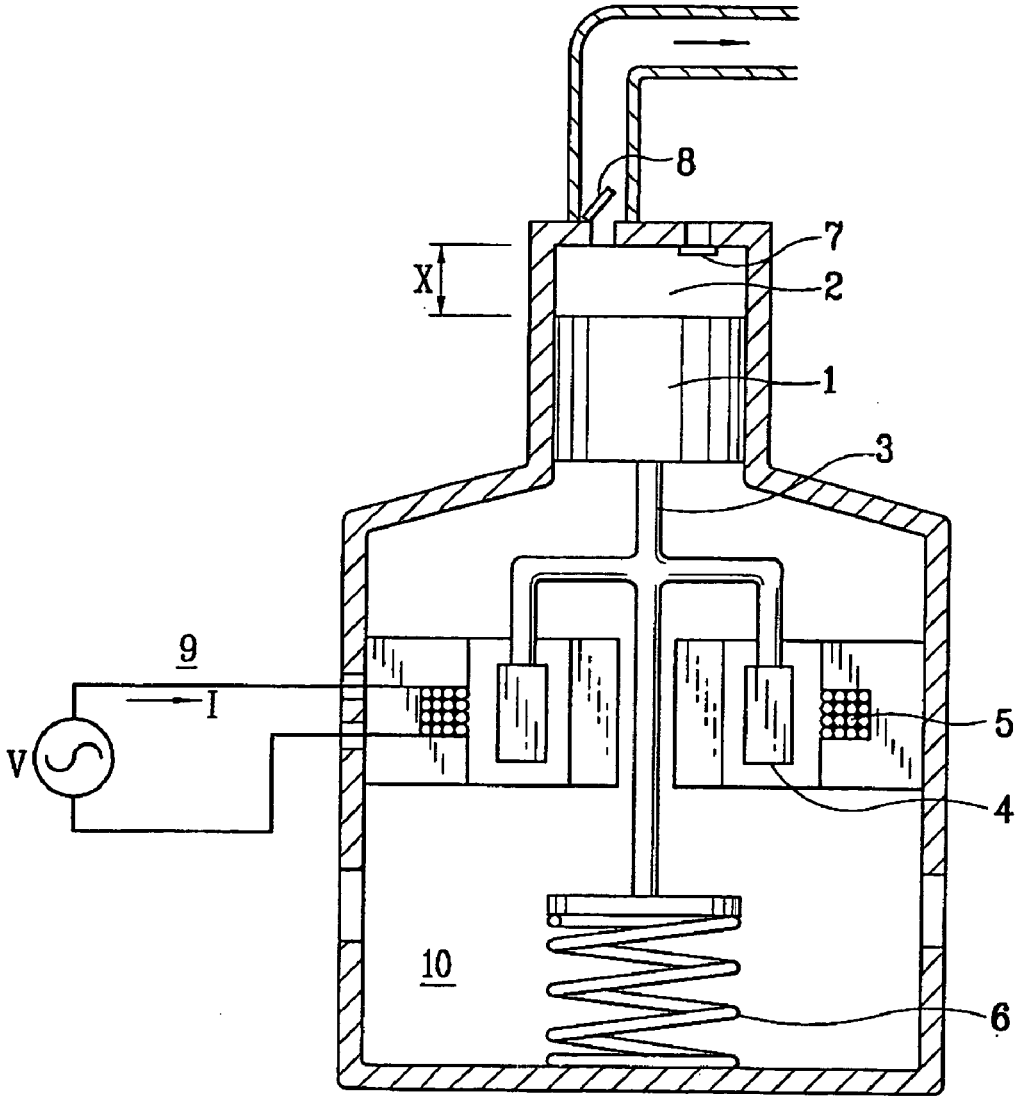
FIG.1 Prior Art
FIG. 1 is a cross sectional view illustrating the construction of a reciprocating compressor disclosed in U.S. Pat. No. 5,342,176.
Figure 2:
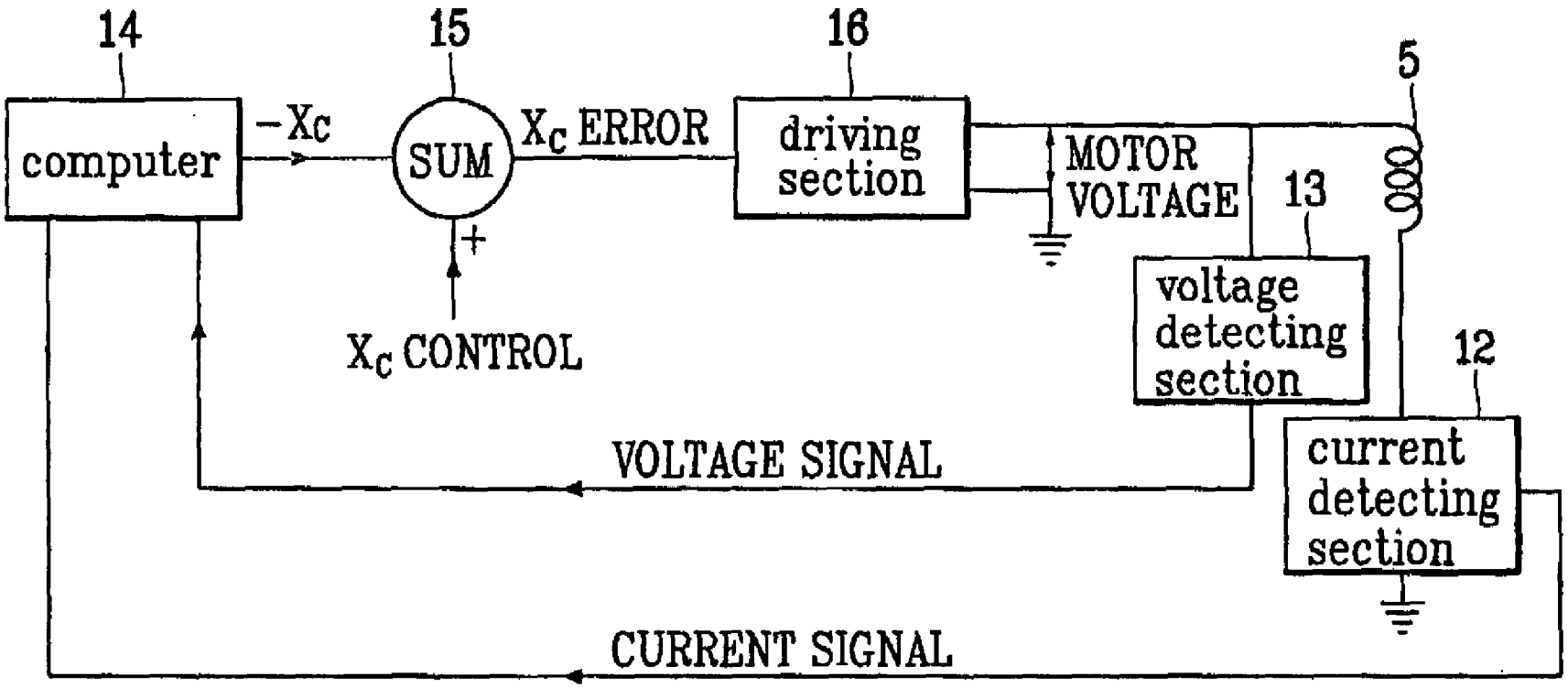
FIG.2 Prior Art
FIG. 2 is a block diagram illustrating a compressor controlling apparatus for controlling a piston stroke of the refrigerant shown in FIG. 1.
Figure 3:
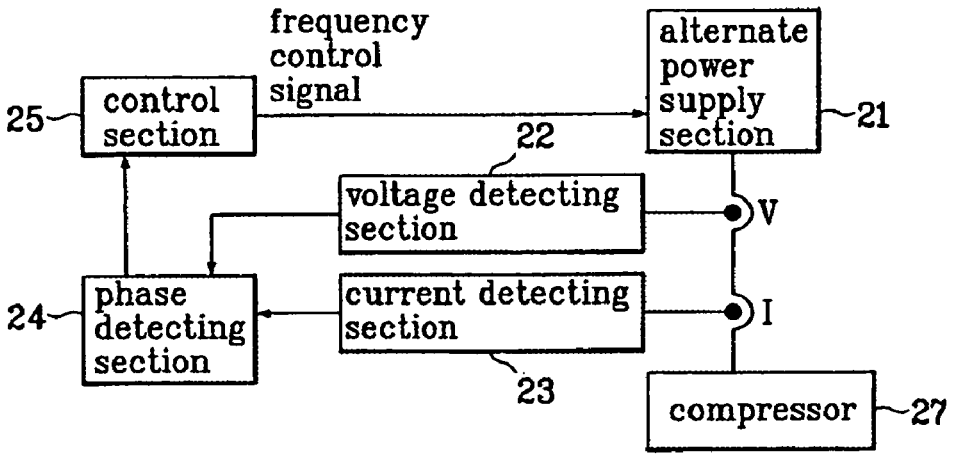
FIG. 3 Prior Art
FIG. 3 is a block diagram of a conventional control apparatus for a reciprocating compressor disclosed in the Japanese Patent Laid-Open Publication hei 9-112438.
Figure 4:
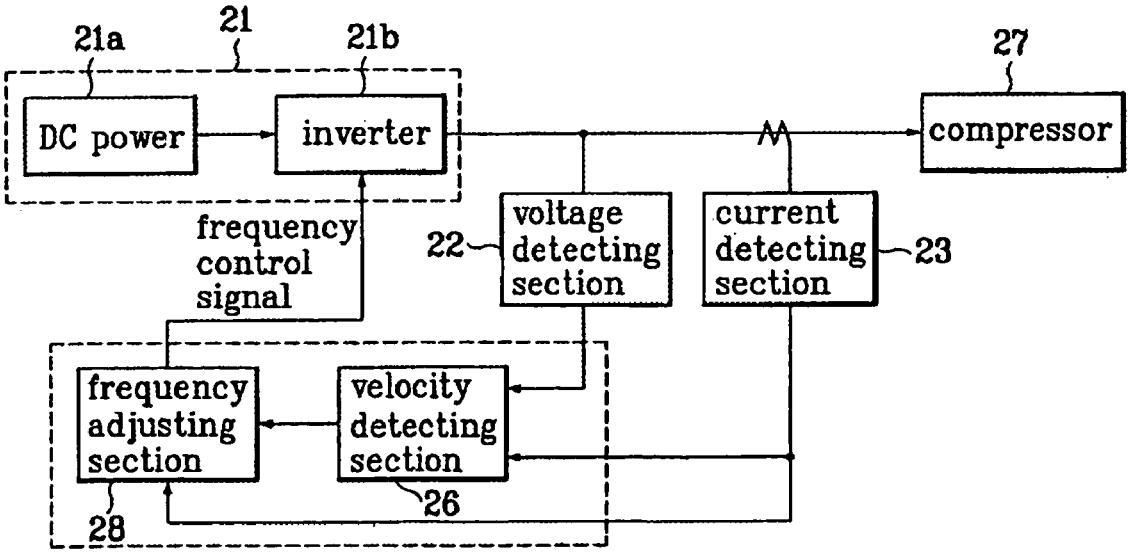
FIG. 4 Prior Art
FIG. 4 is a block diagram of another conventional control apparatus for a reciprocating compressor disclosed in the Japanese Patent Laid-Open Publication hei 9-112438.
Figure 5:
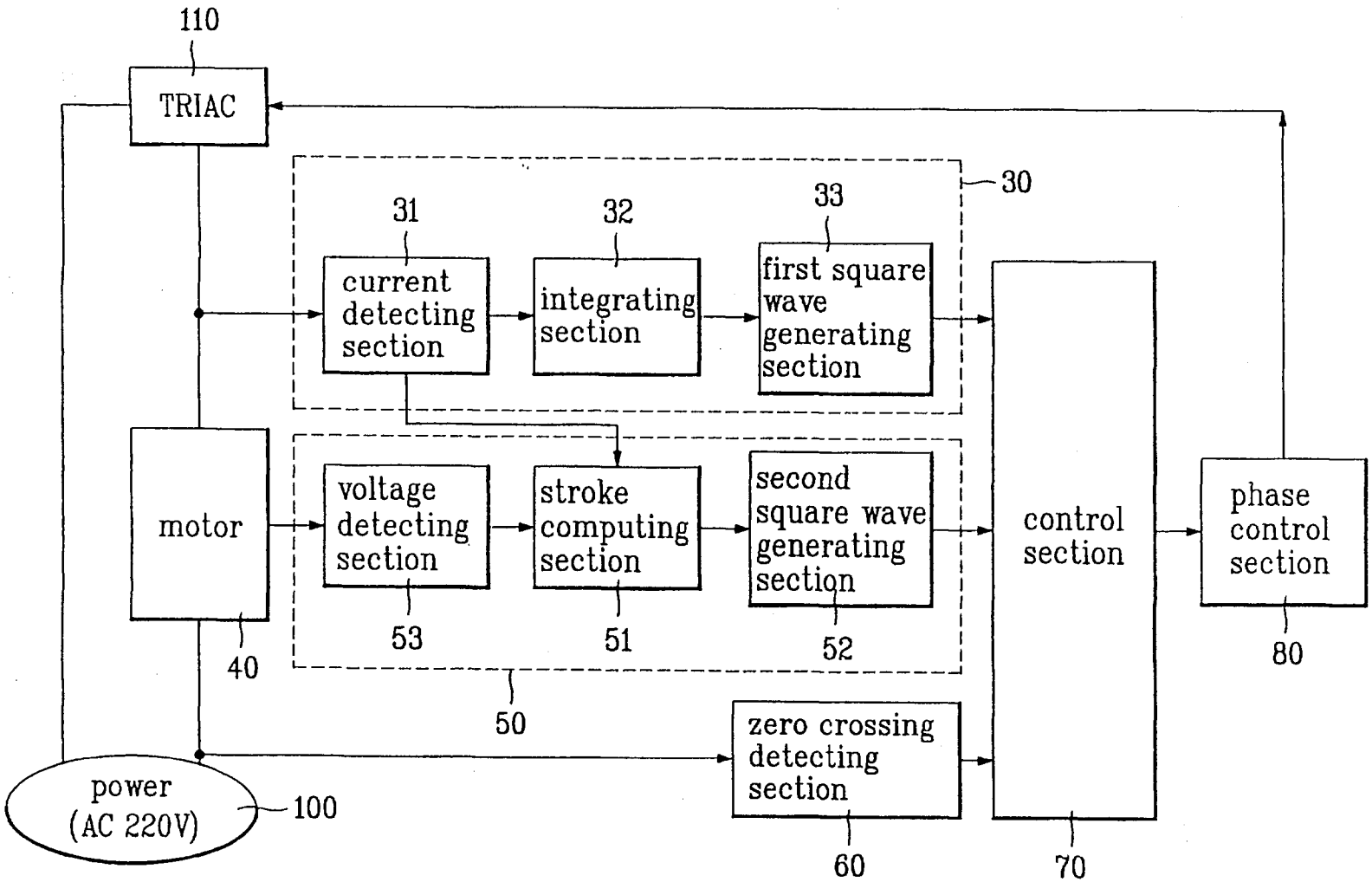
FIG. 5 is a block diagram of an apparatus for controlling a reciprocating compressor according to a first preferred embodiment of the present invention.
Figure 6:
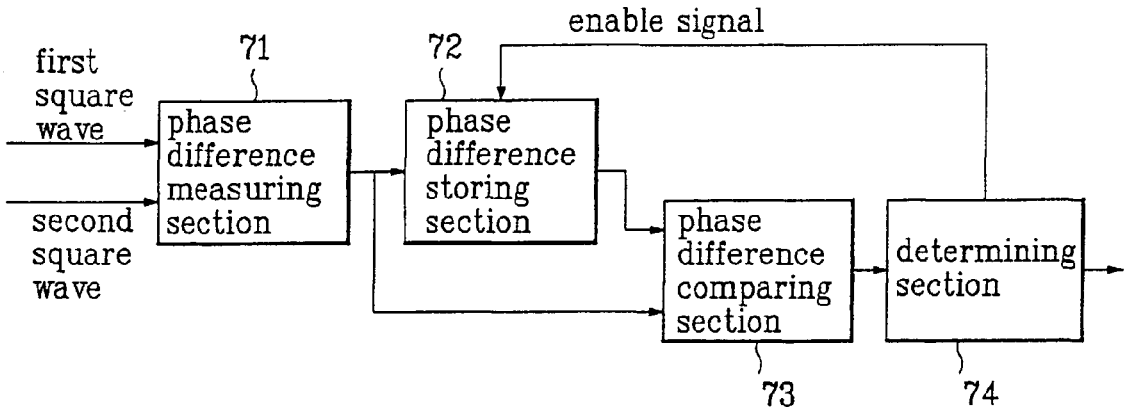
FIG. 6 is a detail diagram of a control section of FIG. 5.

FIG. 5 is a block diagram of an apparatus for controlling a reciprocating compressor according to a first preferred embodiment of the present invention, and FIG. 6 is a detail diagram of a control section of FIG. 5.

The control apparatus of the reciprocating compressor according to the first embodiment of the present invention comprises, as shown in FIG. 5, a power supply section 100 for supplying a common power (alternate current of 100 to 220 V), a TRIAC 110 for switching the common power supplied from the power supply section 100 in response to a triggering signal, a current phase detecting section 30 for detecting a current supplied to the compressor through the TRIAC 110 to produce a first square wave corresponding to the detected current, a motor 40 for reciprocating a piston in a cylinder of the compressor according to the switched common power supplied from the TRIAC 110, a stroke phase detecting section 50 for outputting a second square wave corresponding to the position according to the linear motion of the piston, a zero crossing detecting section 60 for detecting a zero crossing of the common power supplied from the power supply section 100, a control section 70 for outputting the control signal for controlling the position of the piston according to the phase difference between the first square wave produced from the current phase detecting section 30 and the second square wave produced from the stroke phase detecting section 90, and a phase control section 80 for outputting a triggering signal in response to the control signal, wherein the triggering signal controls a switching operation of the TRIAC 110, thereby controlling the stroke of the compressor according to the control signal outputted from the control section 70. By controlling the switching operation of the TRIAC 110, the time during which the common power is supplied to the motor 40 from the TRIAC 110 is controllably delayed. By controllably delaying the time during which the TRIAC 110 switches and supplies common power from the power supply section 100 to the motor 40, the amount of current (i.e., common current) ultimately supplied to the motor 40 is inherently controlled. Because the phase angle of the common current supplied from the power supply section 100 inherently varies sinusoidally with time, the phase anale of the common current at the time the common power is switched and supplied to the motor 40 (i.e., the angle of ignition)

The current phase detecting section 30 includes a current detecting section 31 switched through the TRIAC 110 to detect a current supplied to the motor 40 of the compressor, an integrating section 32 for integrating the current detected from the current detecting section, and a first square wave generating section 33 for generating a first square wave corresponding to the integrated current from the integrating section 32.

The stroke phase detecting section 50 includes a voltage detecting section 53 for detecting a voltage supplied to the motor of the compressor, a stroke computing section 51 for computing the stroke according to the reciprocating motion of the piston according to the voltage value detected from the voltage detecting section 53 and the current value detected from the current detecting section 32, and a second square wave generating section 52 for generating a second square wave corresponding to the stroke computed from the stroke computing section 51.

The control section 70 includes a phase difference measuring section 71 for measuring a phase difference between the first square wave outputted from the current phase detecting section 30 and the second square wave outputted from the stroke phase detecting section 50, a phase difference storing section 72 for storing the phase difference detected from the phase difference measuring section 72 according to the control signal, a phase difference comparing section 73 for comparing the phase difference stored in the phase difference storing section 72 with the phase difference measured from the phase difference measuring section 71, and a determining section 74 for determining a dimension of the angle of ignition according to the compared result from the phase difference comparing section and outputting a stored enable signal of the phase difference storing section 72.

A method for controlling the reciprocating compressor according to the present invention will now be described.

Figure 7:
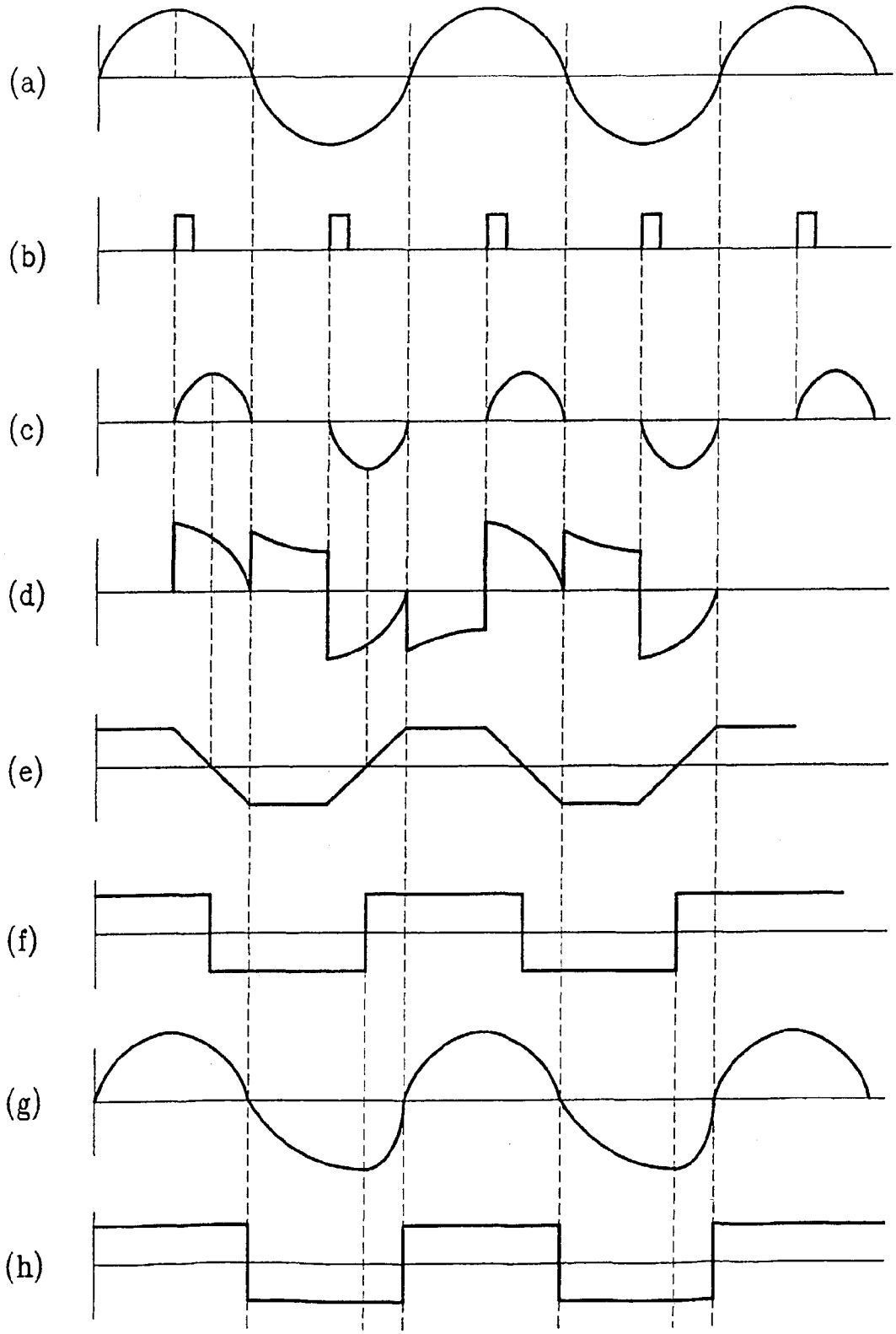
FIGS. 7*a* to 7*h* are views illustrating waveform output from each section of FIG. 5.
Figure 8:
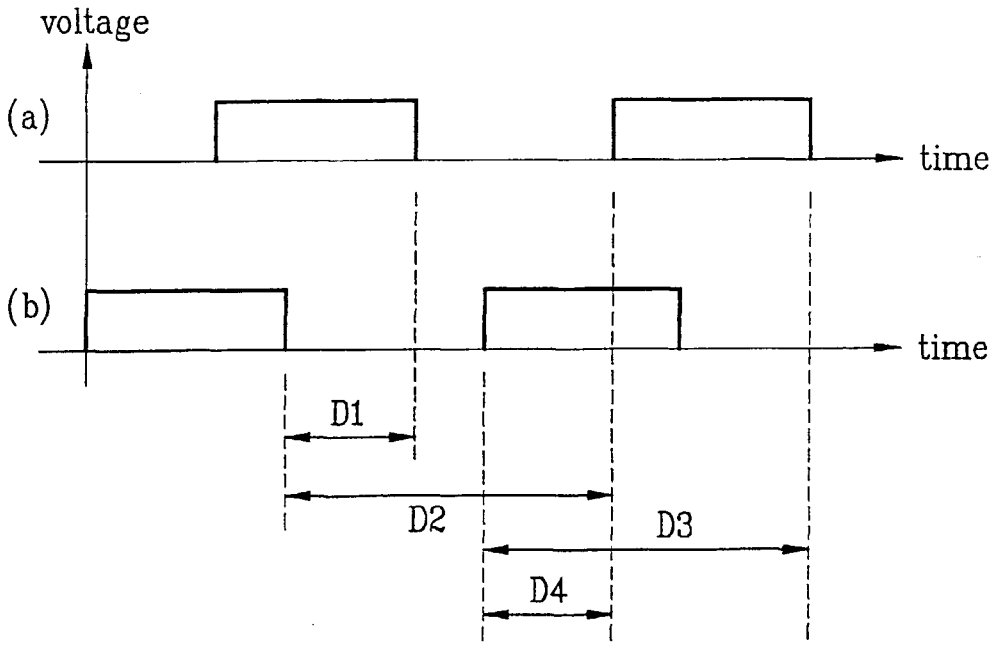
FIGS. 8*a* and 8*b* are views illustrating a phase difference between a current phase and a stroke phase according to the present invention.
Figure 9:
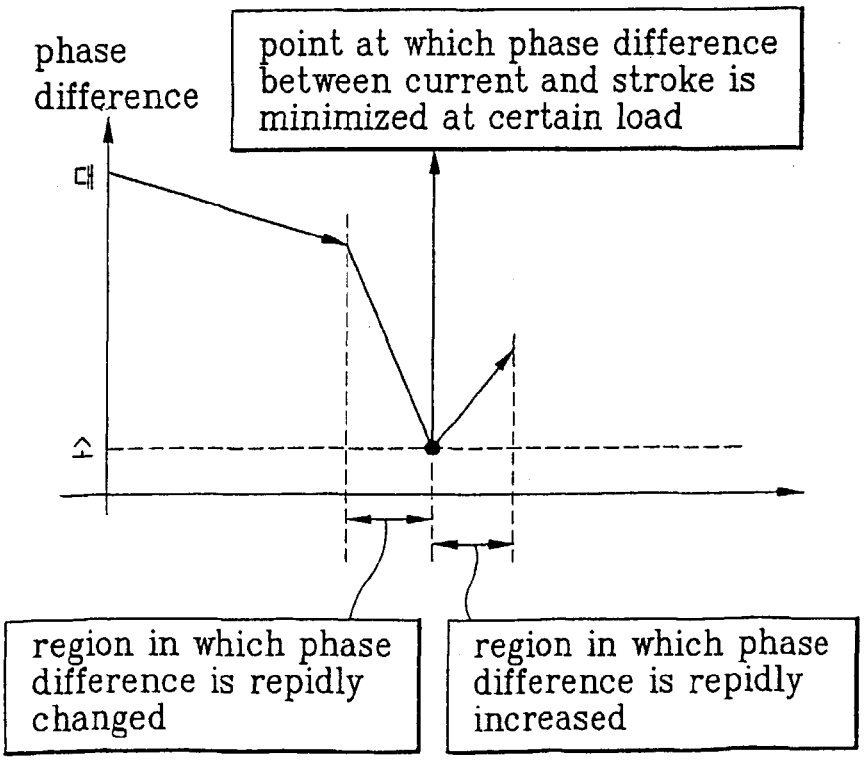
FIG. 9 is a view illustrating a variation at a certain pressure of the current phase and the stroke phase according to the present invention.
Figure 10:
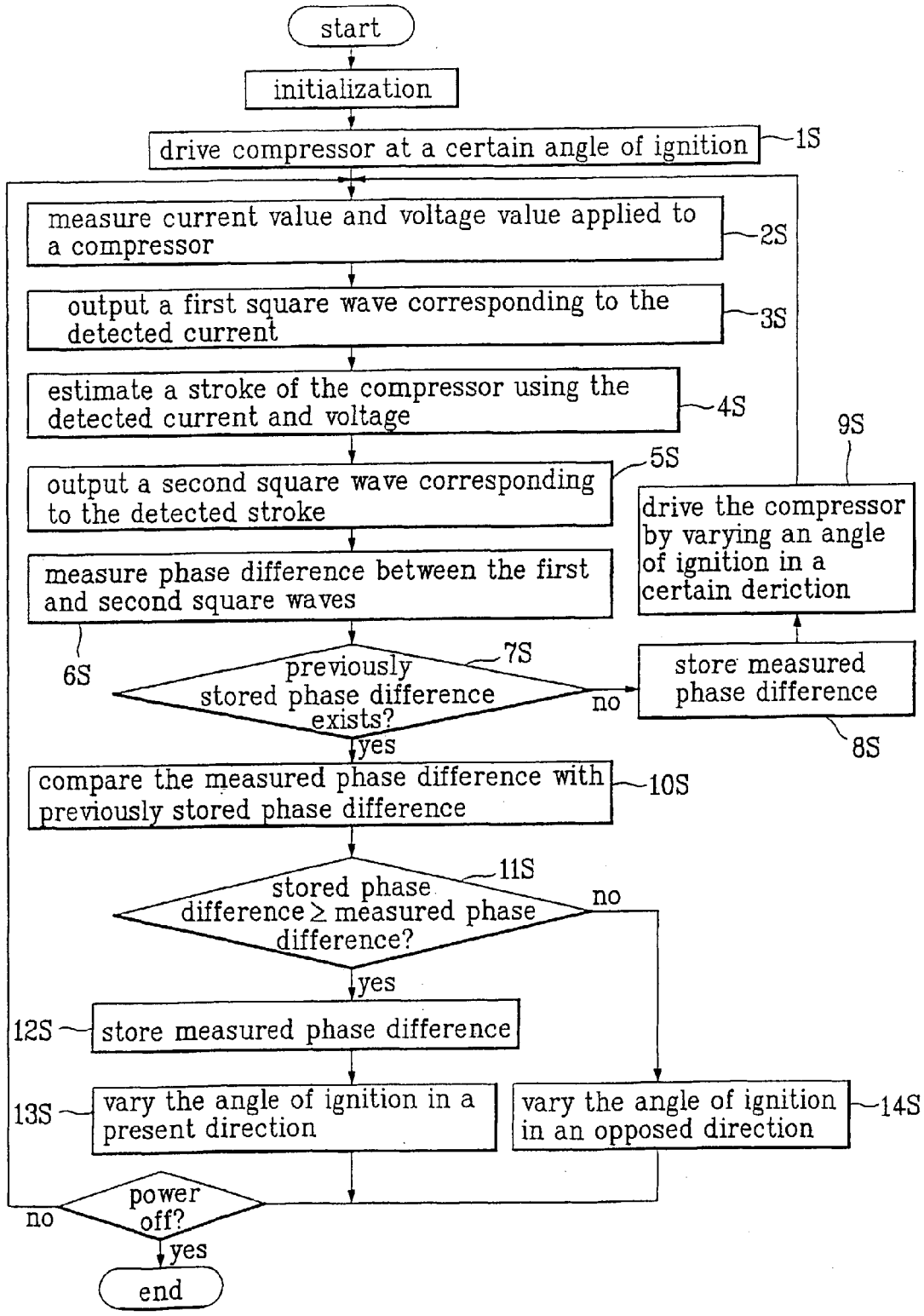
FIG. 10 is a flow chart illustrating a method for controlling a reciprocating compressor according to an embodiment of the present invention.

FIGS. 7*a* to 7*h* are views illustrating a waveform outputted from each section of FIG. 5, FIGS. 8*a* and 8*b* are views illustrating the phase difference between the current phase and the stroke phase according to the present invention, and FIG. 9 is a view illustrating a variation at a certain pressure of the current phase and the stroke phase according to the present invention. FIG. 10 is a flow chart illustrating a method for controlling the reciprocating compressor according to the first embodiment of the present invention.

First of all, it will now describe the controlling method of the compressor according to the first embodiment of the present invention.

The common current supplied from the power supply section 100 has a constant frequency as shown in FIG. 7*a*. As shown in FIG. 7*b*, the phase control section 80 periodically applies a triggering signal to the TRIAC 110 which, in turn, drives the motor 40 of the compressor according to a certain angle of ignition (step 1S).

The current detecting section 31 and the voltage detecting section 53 detect the current and voltage of the power supplied to the motor of the compressor, respectively (step 2S). At that time, the current detected from the current detecting section is detected as shown in FIG. 7*c*, the voltage detected from the voltage detecting section 53 is detected as shown in FIG. 7*d* (counter electromotive force of the motor).

The first square wave corresponding to the current detected from the current phase detecting section 30 is outputted to the control section 70 (step 3S).

Specifically, the integrating section 32 of the current phase detecting section 30 integrates and outputs the current detected from the current detecting section 31, as shown in FIG. 7*e*, and the first square wave generating section 33 generates the first square wave corresponding to the integrated value and outputs it to the control section 70, as shown in FIG. 7*f*.

At that time, the stroke phase detecting section 50 estimates the stroke according to the reciprocating motion of the piston (step 4S), and generates an alternate voltage waveform and generates the second square wave corresponding to the alternate voltage waveform (step 5S), of which a frequency is maintained and an amplitude is varied, depending upon a location of the reciprocating piston.

The stroke estimation is carried out by the following equation.

$$X = \frac{1}{\alpha}\int\left(Vm - Ri - L\frac{di}{dt}\right)dt$$

wherein, Vm is a voltage supplied to both terminals of the motor, I is a current supplied to the motor, R is a resistance of a motor winding, and L is an inductance of the motor winding.

The stroke computing section 51 of the stroke phase detecting section 50 generates the alternate voltage waveform, of which a frequency is maintained and an amplitude is varied, depending upon a location of the reciprocating piston, and the second square wave generating section 52 generates the second square wave corresponding to the alternate voltage waveform generated from the stroke computing section 51, as shown in FIG. 7*h*.

Also, the zero crossing detecting section 60 detects a zero crossing of AC 220 V supplied from the power supply section 100.

The control section 70 detects the phase difference between the first square wave outputted from the current phase detecting section 30 and the second square wave outputted from the stroke phase detecting section 50 using the signal of the zero crossing detecting section 60 (step 6S), and compares the detected phase difference with the stored phase difference (steps 7S to 10S) and outputs the signal for controlling the location of the piston according to the comparison (steps 11S to 15S).

Specifically, the phase difference detecting section 71 of the control section 70 detects the phase difference between the first square wave outputted from the current phase detecting section 30 (as shown in FIG. 8*a*) and the second square wave outputted from the stroke phase detecting section 50 (as shown in FIG. 8*b*)(step 6S). It does not matter to detect an interval (D1) between a downstream edge of the second square wave and a downstream edge of the first square wave, an interval (D2) between a downstream edge of the second square wave and an upstream edge of the first square wave, an interval (D3) between an upstream edge of the second square wave and a downstream edge of the first square wave, or an interval (D4) between an upstream edge of the second square wave and an upstream edge of the first square wave.

At that time, since there is no previous phase difference at an early stage (step 7S), the detected phase difference is stored in the phase differenee storing section 72 (step 8S), and the periodic output of triggering signals is varied in a certain temporal direction to drive the compressor according to a certain varied angle of ignition (step 9S). And then, the processes (steps 2S to 7S) are repeated.

If the phase difference is newly detected through the repeat of the above process (step 7S), the phase difference comparing section 73 of the control section 70 compares the present detected phase difference with the stored phase difference (step 10S), and the determining section 74 of the control section 70 outputs a control signal, based on the comparison, for controlling the phase control section 80. The phase control section 80, in turn, outputs a triggering signal which controls the TRIAC 110, the operation of which controls the angle of ignition. Determining section 74 simultaneously outputs an enable signal for commanding whether the phase difference storing section 72 stores the present detected phase difference or not. Accordingly, the phase control section 80 controls the TRIAC 110 according to the control signal outputted from the determining section 74 of the control section 70, where the operation of the TRIAC 110 ultimately controls the angle of ignition (i.e., the phase angle of the common current at the time the common power is supplied to the motor 40).

Specifically, if the control section 70 compares the present detected phase difference with the stored phase difference (step 10S), and if the present detected phase difference is lower than the stored phase difference (step 11S), the present detected phase difference is newly stored (step 12S), and the control signal, the angle of ignition to be varied in a previously varied direction, is outputted to the phase difference control section 80 to vary the output of the triggering signals (and, thus, the angle of ignition) (step 13S). For example, if the output of the triggering signals is varied in an increasing temporal direction, the output of a triggering signal is delayed and the angle of ignition (i.e., the phase angle of the common current at the time the common power is supplied to the motor 40) is thereby increased, and if the output of the triggering signals is varied in a decreasing temporal direction, the output of a triggering signal is accelerated and the angle of ignition (i.e., the phase angle of the common current at the time the common power is supplied to the motor 40) is thereby decreased.

By contrast, if the control section 70 compares the present detected phase difference with the stored phase difference (step 10S), and if the present detected phase difference is larger than the stored phase difference (step 11S), the present detected phase difference is not stored, and the previously stored phase difference is constantly maintained. The control signal for commanding the output of the triggering signals (and, thus, the angle of ignition) to be varied in a direction opposed to the previously varied direction is outputted to the phase difference control section 80 to vary the output of the triggering signals (and, thus, the angle of ignition) (step 14S). For example, if the output of the triggering signals was previously varied in an increasing temporal direction, the output of a triggering signal is accelerated and the angle of ignition (i.e., the phase angle of the common current at the time the common power is supplied to the motor 40) is thereby decreased, and if the output of the triggering signals was previously varied in a decreasing temporal direction, the output of a triggering signal is delayed and the angle of ignition (i.e., the phase angle of the common current at the time the common power is supplied to the motor 40) is thereby increased.

If the above process is repeated to allow the stored phase difference and the present detected phase difference to be equal to each other (steps 11S and 14S), the stroke of the compressor is controlled, thereby providing a maximum efficiency.

FIG. 9 shows an inflection point in which the phase difference becomes to be minimized. It is regarded that the inflection point is zero of a top clearance of the piston.

In the phase control, in case of initially driving the compressor using significantly delayed triggering signals (i.e., driving the compressor using a sufficiently large initial angle of ignition), the output of the triggering signals is gradually accelerated. Thus, the initial angle of ignition is gradually decreased. In case of becoming the phase difference to be large at a moment, the compressor is controlled by the output of the triggering signals (and, thus, the angle of ignition) controlled at previous step. In order words, the compressor is controlled by the the output of triggering signals (and, thus, the angle of ignition) employed at the inflection point of the phase difference.

Accordingly, the TRIAC 110 switches the voltage supplied from the power supply section 100 according to the triggering signals outputted from the phase control section 80, and, with repeating the above process, the control section 70 controls the piston of the compressor, so that the top clearance is minimized.

A method for controlling the reciprocating compressor according to a second preferred embodiment of the present invention will now be described.

Figure 11:
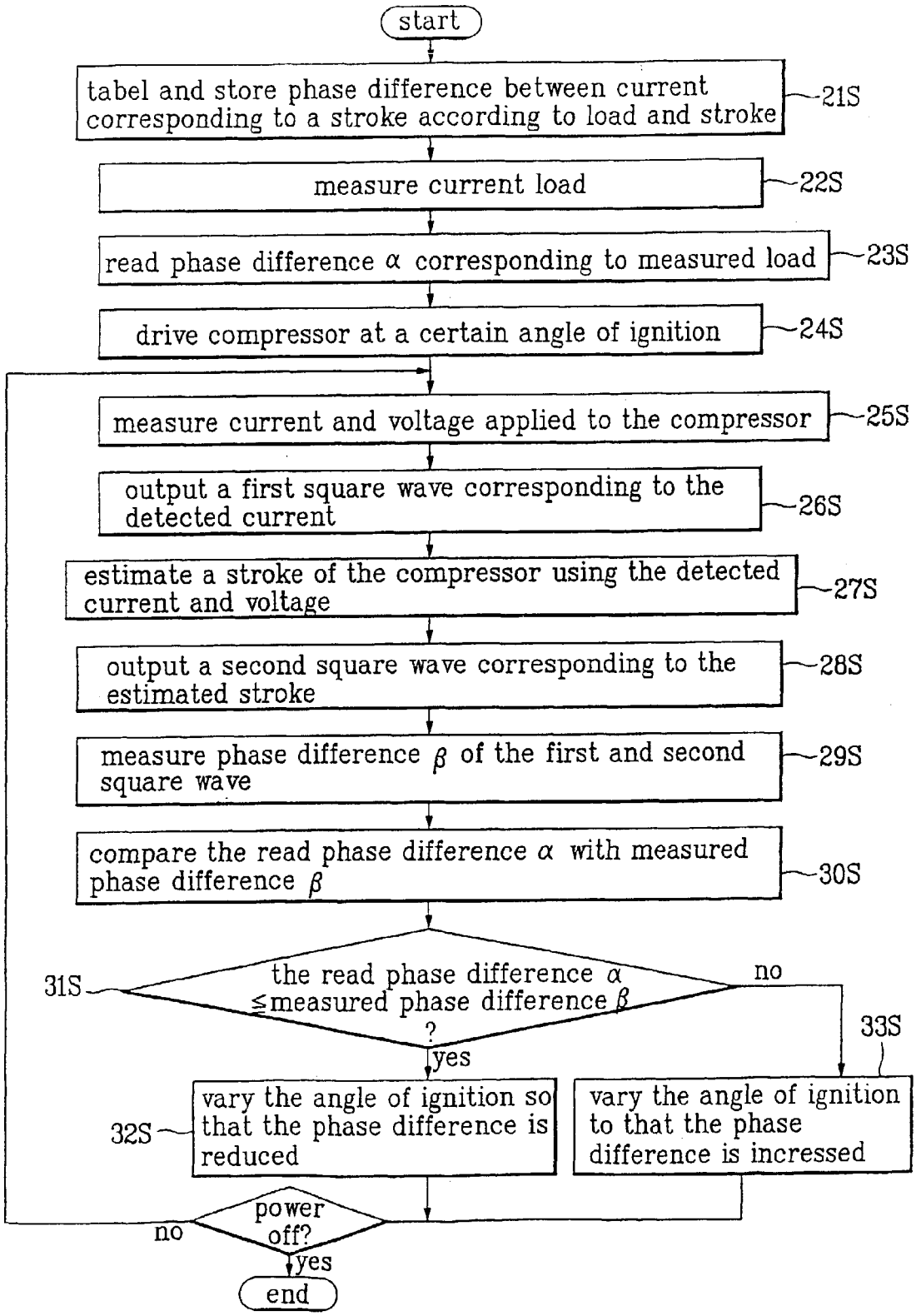
FIG. 11 is a flow chart illustrating a method for controlling the reciprocating compressor according to a second preferred embodiment of the present invention, in which a stroke is controlled depending upon the load.

FIG. 11 is a flow chart illustrating a method for controlling the reciprocating compressor according to the second preferred embodiment of the present invention, in which a stroke is controlled depending upon the load.

The embodiment of the present invention controls the stroke of the piston of the compressor depending upon the load, in which if the load is small, the stroke of the piston is controlled to be small, while if the load is large, the stroke of the piston is controlled to be large. Accordingly, the top clearance is not minimized, but the compressor is controlled to have the top clearance corresponding to the load.

The current phase corresponding to the stroke of the piston depending upon the load acting onto the compressor and the phase difference between the stroke are tabled through several experiments and are stored (step 21S).

A control section 70 measures the load of the refrigerator (step 22S). The method for measuring the load of the compressor is well known in the prior art. The load is measured by detecting a temperature of the inside of the refrigerator, a temperature of the coolant flowing through a heat exchanger, or a temperature of the periphery of the refrigerator. The phase difference (corresponding to the measured load is read from the table (step 23S).

The phase control section 80 applies a triggering signal to the TRIAC 110 to drive the motor 40 of the compressor at a certain angle of ignition (step 24S).

The current detecting section 31 and the voltage detecting section 53 detect the current and voltage of the power supplied to the motor of the compressor, respectively (step 25S). The first square wave corresponding to the current detected from the current phase detecting section 30 is outputted to the control section 70 (step 26S). At that time, the stroke phase detecting section 50 estimates the stroke according to the reciprocating motion of the piston (step 27S), and generates an alternate voltage waveform and generates the second square wave corresponding to the alternate voltage waveform (step 28S).

The stroke estimation is carried out by the following equation.

$$X = \frac{1}{\alpha}\int\left(Vm - Ri - L\frac{di}{dt}\right)dt$$

wherein, Vm is a voltage supplied to both terminals of the motor, I is a current supplied to the motor, R is a resistance of a motor winding, and L is an inductance of the motor winding.

Also, the zero crossing detecting section 60 detects a zero crossing of AC 220 V supplied from the power supply section 100.

The control section 70 detects the phase difference β of the first square wave outputted from the current phase detecting section 30 and the second square wave outputted from the stroke phase detecting section 50 using the signal of the zero crossing detecting section 60 (step 29S), and compares the detected phase difference β with the phase difference α corresponding to the present load read from the table (step 30S).

If the read phase difference α is smaller than the measured phase difference β (step 31S), the the timing of triggering signals output to the TRIAC 110 (and, thus, the angle of ignition) is varied in such a way that the phase difference between the current phase detected from the current phase detecting section 30 and the stroke phase detected from the stroke phase detecting section 50 becomes to be small (step 32S). If the read phase difference α is larger than the measured phase difference β (step 31S), the timing of triggering signals output to the TRIAC 110 (and, thus, the angle of ignition) is varied in such a way that the phase difference between the current phase detected from the current phase detecting section 30 and the stroke phase detected from the stroke phase detecting section 50 becomes to be large (step 33S). At that time, the method for varying the output of the triggering signals (and, thus, the angle of ignition) is similar to that of the first embodiment of the present invention.

If the above process is repeated to similar the phase difference corresponding to the load to the detected phase difference (steps 25S to 33S), it is possible to control the compressor to be operated at a stroke suitable for the load.

The following effects are provided with the apparatus and method for controlling the reciprocating compressor according to the present invention.

The location of the piston in the cylinder is controlled so that the top clearance is minimized based on the information of the phase difference between the current square wave produced by the phase control and the square wave produced by the stroke. Therefore, since the complicated operation is not needed, the reciprocating compressor may be controlled to have a maximum efficiency using an inexpensive cost.

Since the compressor is controlled by the stroke corresponding to the load, it is unnecessary to drive the compressor during a desired time and to stop the compressor during a desired time, thereby extending a lifetime of the compressor and minimizing the noise of the compressor.

At that time, since there is no previous phase difference at an early stage (step 7S), the detected phase difference is stored in the phase difference storing section 72 (step 8S), and the output of the triggering signals is varied in a certain temporal direction to drive the compressor according to a certain varied angle of ignition (step 9S). And then, the processes (steps 2S to 7S) are repeated.

If the phase difference is newly detected through the repeat of the above process (step 7S), the phase difference comparing section 73 of the control section 70 compares the present detected phase difference with the stored phase difference (step 10S), and the determining section 74 of the control section 70 outputs a control signal for controlling a variable output of the triggering signals, thereby controlling a variable angle of ignition according to the comparison results, and simultaneously outputs an enable signal for commanding whether the phase difference storing section 72 stores the present detected phase difference or not. Accordingly, the phase control section 80 controls the operation of the TRIAC 110 according to the control signal outputted from the determining section 74 of the control section 70 to ultimately control the angle of ignition (i.e., the phase angle of the common current at the time the common power is supplied to the motor 40).

Specifically, if the control section 70 compares the present detected phase difference with the stored phase difference (step 10S), and if the present detected phase difference is lower than the stored phase difference (step 11S), the present detected phase difference is newly stored (step 12S), and the control signal for commanding the the output of the triggering signals (and, thus, the angle of ignition) to be varied in a previously varied direction is outputted to the phase difference control section 80 to vary the output of the triggering signals (and, thus, the angle of ignition) (step 13S). For example, if the output of the triggering signals is varied in an increasing temporal direction, the output of a triggering signal is delayed and the angle of ignition (i.e., the phase angle of the common current at the time the common power is supplied to the motor 40) is thereby increased, and if the output of the triggering signals is varied in a decreasing temporal direction, the output of a triggering signal is accelerated and the angle of ignition (i.e., the phase angle of the common current at the time the common power is supplied to the motor 40) is thereby decreased.

By contrast, if the control section 70 compares the present detected phase difference with the stored phase difference (step 10S), and if the present detected phase difference is larger than the stored phase difference (step 11S), the present detected phase difference is not stored, and the previously stored phase difference is constantly maintained. The control signal for commanding the output of the triggering signals (and, thus, the angle of ignition) to be varied in a direction opposed to the previously varied direction is outputted to the phase difference control section 80 to vary the output of the triggering signals (and, thus, the angle of ignition) (step 14S). For example, if the output of the triggering signals was previously varied in an increasing temporal direction, the output of a triggering signal is accelerated and the angle of ignition (i.e., the phase angle of the common current at the time the common power is supplied to the motor 40) is thereby decreased, and if the output of the triggering signals was previously varied in a decreasing temporal direction, the output of a triggering signal is delayed and the angle of ignition (i.e., the phase angle of the common current at the time the common power is supplied to the motor 40) is thereby increased.

If the above process is repeated to allow the stored phase difference and the present detected phase difference to be equal to each other (steps 11S and 14S), the stroke of the compressor is controlled, thereby providing a maximum efficiency.

INDUSTRIAL APPLICABILITY

As apparent from the above description, according to the present invention, since the position of the piston in the cylinder is controlled so that the top clearance is minimized according to the information of phase difference between the square wave of the current and the square wave of the stroke, there is no needed a complicated calculation, thereby inexpensively and efficiently controlling the reciprocating compressor and improving the reliability thereof.

Since the compressor is controlled by the stroke corresponding to the load, it is unnecessary to drive and stop the compressor during a constant period, thereby extending a lifetime of the compressor and minimizing the noise the compressor.

We claims:

1. An apparatus for controlling a reciprocating compressor, the apparatus comprising:

a driving section for driving the reciprocating compressor by varying an angle of ignition in response to a control signal;

a current phase detecting section for outputting a square wave corresponding to a detected current supplied to the compressor;

a stroke phase detecting section for outputting a square wave corresponding to a stroke of the compressor; and a control section for outputting the control signal and for controlling the angle of ignition of the driving section according to the phase difference between the square wave produced from the current phase detecting section and the square wave produced from the stroke phase detecting section.

2. The apparatus as claimed in claim 1, wherein the current phase detecting section includes:

a current detecting section for detecting the current supplied to the compressor to output a detected current value; and a first square wave generating section for outputting a first square wave corresponding to the current detected from the current detecting section.

3. The apparatus as claimed in claim 2, wherein the current phase detecting section further includes an integrating section for integrating the current detected from the current detecting section and for outputting the integrated current to the first square wave generating section.

4. The apparatus as claimed in claim 1, wherein the stroke phase detecting section includes:

a voltage detecting section for detecting a voltage supplied to the compressor;

a stroke computing section for computing the stroke based on the voltage detected from the voltage detecting section and the current detected from the current detecting section; and a second square wave generating section for generating a second square wave corresponding to the stroke computed from the stroke computing section and for outputting the second square wave to the control section.

5. The apparatus as claimed in claim 1, wherein the control section includes:

a phase difference measuring section for measuring a phase difference between a current waveform generated by the current phase detecting section and a stroke waveform generated by the stroke phase detecting section; and an output voltage commanding section for determining a target output voltage according to a size of the phase difference measured from the phase difference measuring section.

6. The apparatus as claimed in claim 5, wherein the output voltage commanding section includes:

a phase difference storing section for storing the phase difference detected from the phase difference measuring section;

a phase difference comparing section for comparing the phase difference stored in the phase difference storing section with the phase difference measured from the phase difference measuring section; and a determining section for determining the voltage to be supplied to the compressor according to the compared result from the phase difference comparing section and for outputting a write enable signal of the phase difference storing section.

7. The apparatus as claimed in claim 1, wherein the determining section determines whether a top of clearance is zero when the phase difference is minimized.

8. The apparatus as claimed in claim 6, wherein:

the determining section outputs a write enable signal when the phase difference detected from the phase difference measuring section is lower than that stored in the phase difference storing section;

the phase difference storing section stores the phase difference detected from the phase difference measuring section in response to the write enable signal.

9. The apparatus as claimed in claim 1, wherein the driving section includes:

a TRIAC for supplying the power to the compressor in response to a triggering signal; and a phase control section for outputting the triggering signal in response to the control signal, thereby controlling the angle of ignition and the stroke of the compressor.

10. The apparatus as claimed in claim 9, wherein the TRIAC switches the power according to the triggering signal generated by the phase control section.

11. The apparatus as claimed in claim 1, further comprising a zero crossing detecting section for detecting a zero crossing of a voltage of the power supplied from the driving section.

12. A method for controlling a reciprocating compressor, the method comprising the steps of:

a) driving the compressor by varying an angle of ignition;

b) measuring a phase difference between a current phase supplied to the compressor and a stroke phase of the compressor when the angle of ignition is varied;

c) comparing the measured phase differences; and d) driving the compressor at the angle of ignition corresponding to an inflection point of the phase difference.

13. The method as claimed in claim 12, wherein the phase difference is minimized at the inflection point.

14. The method as claimed in claim 12, wherein the current phase is generated by detecting the current supplied to the compressor and integrating the detected current.

15. The method as claimed in claim 12, wherein the stroke phase is outputted as a pulse corresponding to an estimated value after detecting the voltage and the current supplied to the compressor and estimating the stroke using the detected voltage and current.

16. The method as claimed in claim 12, wherein the step of driving the compressor comprises the steps of:

storing the detected phase difference when the compressor is driven at an initial angle of ignition;

measuring the phase difference by varying the angle of ignition in a desired direction;

comparing the measured phase difference with a previously stored phase difference;

substituting the measured phase difference for the stored phase difference if the measured phase difference is smaller than the stored phase difference; and repeating the measuring, comparing and substituting steps by varying the angle of ignition in the desired direction.

17. The method as claimed in claim 16, further comprising the step of:

varying the angle of ignition in a direction opposite to the desired direction if the measured phase difference is larger than the initially stored phase difference.

18. The method as claimed in claim 16, further comprising the step of:

controlling the compressor by controlling the angle of ignition to maintain a phase difference corresponding to an inflection point of a previous step if the measured phase difference is larger than the previously stored phase difference.

19. The method as claimed in claim 12, wherein the step of driving the compressor comprises the step of:

setting the angle of ignition to supply a current having a first value to the compressor at an early stage and thereafter increasing the current supplied to the compressor; and wherein the method of claim 12 further comprises the step of:

controlling the compressor by controlling the angle of ignition to maintain a phase difference corresponding to the inflection point of a previous step when the measured phase difference is larger than the previously stored phase difference.

20. A method for controlling a reciprocating compressor, the method comprising the steps of:

a) driving the compressor at a desired angle of ignition;

b) measuring and storing a phase difference between a first square wave corresponding to a current supplied to the compressor and a second square wave corresponding to an estimated stroke of the compressor;

c) varying the desired angle of ignition in a desired direction;

d) measuring a phase difference between a first square wave corresponding to the current supplied to the compressor and a second square wave corresponding to an estimated stroke of the compressor as a function of the angle of ignition;

e) comparing the measured phase difference with a stored phase difference;

f) varying the desired angle of ignition in a direction opposite to the desired direction if the measured phase difference is larger than the stored phase difference;

g) substituting the measured phase difference for the stored phase difference and varying the angle of ignition in the desired direction if the measured phase difference is smaller than the stored phase difference; and h) repeating steps c to g to drive the compressor at a point in which the measured phase difference is minimized.

21. A method for controlling a reciprocating compressor, the method comprising the steps of:

a) driving the compressor at an initial angle of ignition;

b) measuring and storing a phase difference between a first square wave corresponding to a current supplied to the compressor and a second square wave corresponding to a stroke of the compressor;

c) varying the initial angle of ignition;

d) measuring a phase difference between the first square wave and the second square wave as a function of the angle of ignition;

e) comparing the measured phase difference with a stored phase difference;

f) varying the angle of ignition such that the measured phase difference is smaller than the stored phase difference; and g) controlling the compressor at an angle of ignition at which the measured phase difference is minimized.

22. A method for controlling a position of a piston in a reciprocating compressor, the method comprising the steps of:

a) generating a first square wave corresponding to a current supplied to the compressor, where the timing of the first square wave is associated with a certain angle of ignition;

b) generating a second square wave corresponding to a stroke of the compressor; and c) adjusting the angle of ignition according to a phase difference between the first and second square waves, thereby controlling the operation of the compressor.

23. The method as claimed in claim 22, wherein the step of adjusting the angle of ignition comprises the step of:

outputting a control signal for minimizing a top clearance of the piston according to the phase difference between the first and second square waves.

24. A method for controlling a reciprocating compressor, the method comprising the steps of:

a) tabling and storing a phase difference between a current corresponding to a load and a stroke;

b) measuring a present load, and reading the phase difference corresponding to the measured load from the table;

c) measuring a phase difference between a current supplied to the compressor and a stroke of the compressor by driving the compressor at an initial angle of ignition; and d) comparing the measured phase difference with the read phase difference to vary the initial angle of ignition so that the measured phase difference is minimized.

25. The method as claimed in claim 24, wherein the step of measuring a phase difference includes the steps of:

detecting the current supplied to the compressor and generating a first square wave corresponding to the current;

detecting a voltage supplied to the compressor;

calculating the stroke of the compressor using the detected voltage and current;

generating a second square wave corresponding to the calculated stroke; and measuring a phase difference between the first and second square waves.

26. The method as claimed in claim 25, wherein the first square wave is generated by integrating the detected current.

27. The method as claimed in claim 24, wherein the step of measuring a phase difference comprises the step of:

setting the initial angle of ignition such that the phase difference between the current supplied to the compressor and the stroke of the compressor is larger than the read phase difference; and wherein the step of comparing the measured phase difference comprises the steps of:

controlling the angle of ignition to decrease the phase difference between the current supplied to the compressor and the stroke of the compressor comparing the measured phase difference with the read phase difference, and controlling the compressor at a previous angle of ignition when the measured phase difference is smaller than the read phase difference.

* * * * *